US007835533B2

(12) United States Patent
Yonehara et al.

(10) Patent No.: US 7,835,533 B2
(45) Date of Patent: Nov. 16, 2010

(54) METHOD FOR MANUFACTURING CONDENSER MICROPHONE

(75) Inventors: Kentaro Yonehara, Shizuoka (JP); Yoshio Imahori, Shizuoka (JP); Hiroshi Fujinami, Shizuoka (JP); Yasunori Tsukuda, Shizuoka (JP); Motoaki Ito, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 1149 days.

(21) Appl. No.: 11/491,252

(22) Filed: Jul. 24, 2006

(65) Prior Publication Data

US 2007/0017077 A1 Jan. 25, 2007

(30) Foreign Application Priority Data

Jul. 22, 2005 (JP) ..... P2005-213161
Jul. 29, 2005 (JP) ..... P2005-221254

(51) Int. Cl.
*H04R 25/00* (2006.01)
*H04R 31/00* (2006.01)

(52) U.S. Cl. ..... 381/150; 29/594

(58) Field of Classification Search ..... 381/150, 381/174, 369; 29/594
See application file for complete search history.

(56) References Cited

FOREIGN PATENT DOCUMENTS

JP 2002-345092 A 11/2002

*Primary Examiner*—Brian Ensey
(74) *Attorney, Agent, or Firm*—Sughrue Mion, PLLC

(57) ABSTRACT

A circuit board forming member, a case forming member, a spacer forming member, a diaphragm sheet and a diaphragm plate forming member are laminated to form a portion, as excepting a back plate and a contact spring, of a condenser microphone, in plurality in a laminate. Moreover, the back plate and the contact spring are arranged in the air chamber, which is defined by the individual forming members, to form a plurality of condenser microphone constituents in the laminate. Next, the laminate is cut to separate the individual condenser microphone constituents thereby to manufacture the condenser microphones.

19 Claims, 11 Drawing Sheets

METHOD FOR MANUFACTURING CONDENSER MICROPHONE

BACKGROUND OF THE INVENTION

1. Field of the Invention

This invention relates to a method for manufacturing a condenser microphone to be used in a mobile telephone, a video camera, a personal computer or the like.

2. Description of the Related Art

JP-A-2002-345092 discloses a condenser microphone of this kind and its manufacturing method. In JP-A-2002-345092, there are laminated an electrode board assembly composed of a plurality of electrode boards, a back electrode board assembly having a plurality of back plates fixed thereon, a spacer assembly composed of a plurality of spacers, and a diaphragm supporting frame assembly composed of a plurality of diaphragm supporting frames and having a diaphragm adhered thereto. As a result, a laminate is formed to have a plurality of condenser microphone constituting bodies. Next, this laminate is cut to separate the individual condenser microphone constituting bodies, which constitute condenser microphones individually.

SUMMARY OF THE INVENTION

The condenser microphone manufactured by the manufacturing method disclosed in JP-A-2002-345092 can have an improved productivity, because it needs no work of assembling the microphone assembly in a housing unlike the general condenser microphone manufacturing method of the related art.

Generally speaking, the condenser microphone is mounted by the reflow soldering method on the circuit board of the mobile telephone or the like. At this time, the individual parts of the condenser microphone are thermally expanded with the heat resulting from the reflow soldering operation. The condenser microphone manufactured by the method of JP-A-2002-345092 is configured such that the back plates are made of a back electrode board assembly integrated with a frame-shaped board body. As a matter of fact, the condenser microphone is housed, when used, in a metallic shield case. If, therefore, the thermal expansion coefficient of the individual constituting bodies of the condenser microphone is larger than that of the shield case when the heat is applied to the condenser microphone housed in the shield case, the condenser microphone may be strangled by the shield case, and the spacer may be deformed to have its thickness reduced. As a result, the spacing between the back plate and the diaphragm may be made smaller than a set value to deteriorate the sensitive characteristics.

An object of this invention is to provide a condenser microphone manufacturing method capable of improving productivity and suppressing the occurrence of thermal troubles, which might otherwise be caused by a soldering operation or the like.

According to a first aspect of the invention, there is provided a method for manufacturing a condenser microphone using: a case forming member having a plurality of holes for forming air chambers individually; a circuit board forming member having a plurality of impedance conversion circuits corresponding to the individual air chambers; a spacer forming member for forming a plurality of spacers corresponding to the individual air chambers; a diaphragm sheet for forming a plurality of diaphragms corresponding to the individual spacers; and a diaphragm plate forming member for forming a plurality of diaphragm plates corresponding to the individual diaphragms, characterized by: laminating the circuit board forming member, the case forming member, the spacer forming member, the diaphragm sheet and the diaphragm plate forming member; arranging, for each of the air chambers formed by the lamination, the back plate and the contact spring for elastically biasing the back plate to hold the back plate in abutment against the spacer forming member and for conducting the back plate with the impedance conversion circuits; jointing the individual laminated members integrally to form a laminate composed of a plurality of condenser microphone constituting bodies; and cutting the laminate to separate the individual condenser microphone constituting bodies.

According to a second aspect of the invention, the spacer forming member has a plurality of through holes for defining the spacers so that the laminate is cut at the portions of the individual through holes.

According to a third aspect of the invention, the case forming member has a plurality of through holes around the holes so that the laminate is cut at the portions of the individual through holes.

According to a fourth aspect the invention, the through holes of the spacer forming member and the through holes of the case forming member are formed in the laminate at mutually corresponding positions.

According to a fifth aspect of the invention, the diaphragm plate forming member, the diaphragm sheet and the spacer forming member are individually provided with mutually communicating through holes, through which the diaphragm plate forming member and the impedance conversion circuit are made conductive.

According to a sixth aspect of the invention, the spacer forming member, the diaphragm sheet and the diaphragm plate forming member are integrally laminated into a diaphragm assembly, which is then integrated with the case forming member.

According to a seventh aspect of the invention, a cover forming member for forming a cover to cover the diaphragm is further integrally laminated at the laminate on the side of the diaphragm plate forming member and is then cut.

According to an eighth aspect of the invention, the microphone further includes a cover member, in which a tensing portion for tensing the diaphragm on the opposite side of the casing across the diaphragm and a protecting portion arranged to cover and protect the diaphragm are integrally formed.

According to a ninth aspect of the invention, the cover member is made of a metal sheet.

According to a tenth aspect of the invention, the cover member has a recess formed in the face of the protecting portion on the side of the diaphragm so that the portion, as corresponding to the recess, of the diaphragm can vibrate.

According to an eleventh aspect of the invention, the cover member is formed of a circuit board.

According to a twelfth aspect of the invention, the recess is formed by forming the tensing portion of the circuit board into an area having an electrode pattern layer on its surface and by forming the protecting portion into an area having no electrode pattern layer on its surface, so that the portion, as corresponding to the recess, of the diaphragm can vibrate.

According to this invention, the circuit board forming member, the case forming member, the spacer forming member, the diaphragm sheet and the diaphragm plate forming member are laminated, and the laminate having a plurality of condenser microphone constituting bodies is formed by arranging the back plates and the contact springs in the air chambers formed by the individual forming members. This laminate is cut to separate the individual condenser microphone constituting bodies so that the individual condenser microphone constituting bodies are adopted as the condenser microphones. Therefore, the productivity is improved better than conventional manufacturing method, in which the condenser microphones are manufactured one by one. In the air chamber of each condenser microphone constituting body, moreover, the back plate is elastically biased by the contact spring so that it is held in abutment against the spacer. As a result, the heat resulting from the reflow soldering operation is applied to the condenser microphone. The force, as applied due to the difference in the thermal expansion coefficient to the condenser microphone, is not applied to the spacer. As a result, the spacer is not deformed to have its thickness reduced, and the distance between the back plate and the spacer does not become less than the set value so that the sensitivity characteristics are not degraded. Therefore, it is possible to improve the productivity and to suppress the occurrence of thermal troubles, which might otherwise be caused by a product soldering operation or the like. Moreover, the back plate is composed of the independent parts and covered with the exterior parts of the microphone. As a result, the heat at the reflow soldering time can not be directly transferred thereby to suppress the attenuation of electric charges in the back plate due to the heat at the reflow soldering time.

If, moreover, the spacer forming member has a plurality of through holes for defining the spacers so that the laminate is cut at the portions of the individual through holes, the cutting resistance in the cutting operation of the laminate is reduced to facilitate the cutting operation. As a result, the productivity of the condenser microphone is improved far better.

If, moreover, the case forming member has a plurality of through holes around the holes so that the laminate is cut at the portions of the individual through holes, the cutting resistance in the cutting operation of the laminate is reduced to facilitate the cutting operation. As a result, the productivity of the condenser microphone is improved far better.

If, moreover, the through holes of the spacer forming member and the through holes of the case forming member are formed in the laminate at mutually corresponding positions, the cutting operation of the laminate is more easier so that the productivity is improved far better.

If, moreover, the spacer forming member, the diaphragm sheet and the diaphragm plate forming member are integrally laminated into a diaphragm assembly, which is then integrated with the case forming member, the adjustment in the tension of the diaphragm is made easier than that of the case, in which those individual members are laminated and integrated at a time. As a result, the manufacture of the condenser microphone is made far easier.

DETAILED DESCRIPTION OF THE PREFERRED EMBODIMENTS

A first embodiment of this invention will be described with reference to FIG. 1 to FIG. 8.

Figure 1:
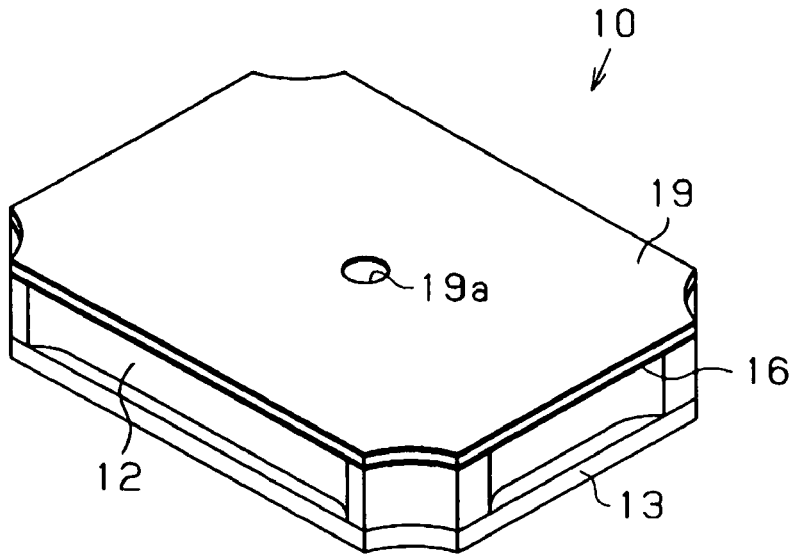
FIG. 1 is a perspective view showing a condenser microphone according to a first embodiment.
Figure 2:
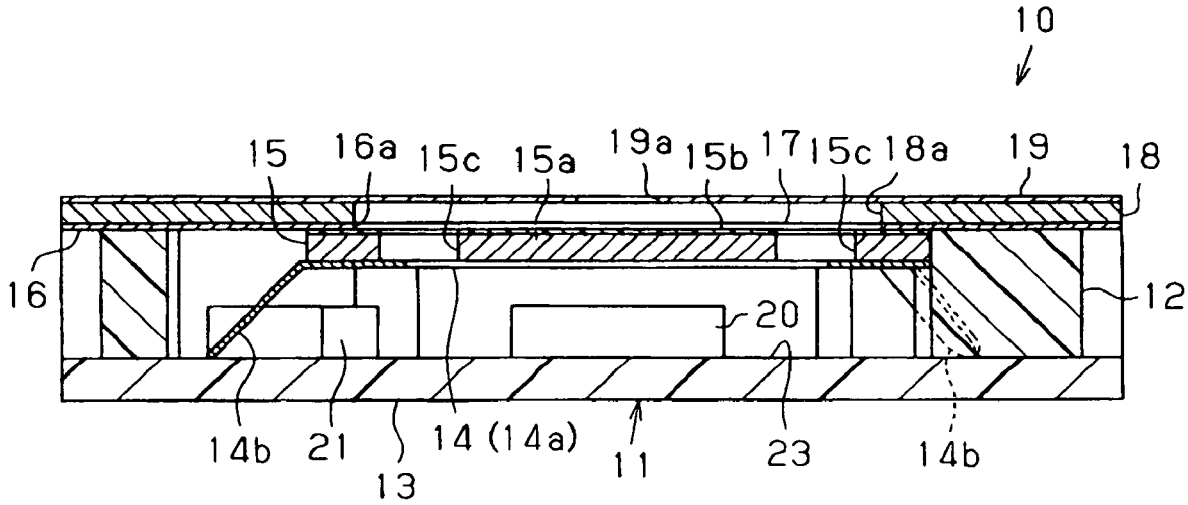
FIG. 2 is a longitudinal section showing the condenser microphone.
Figure 3:
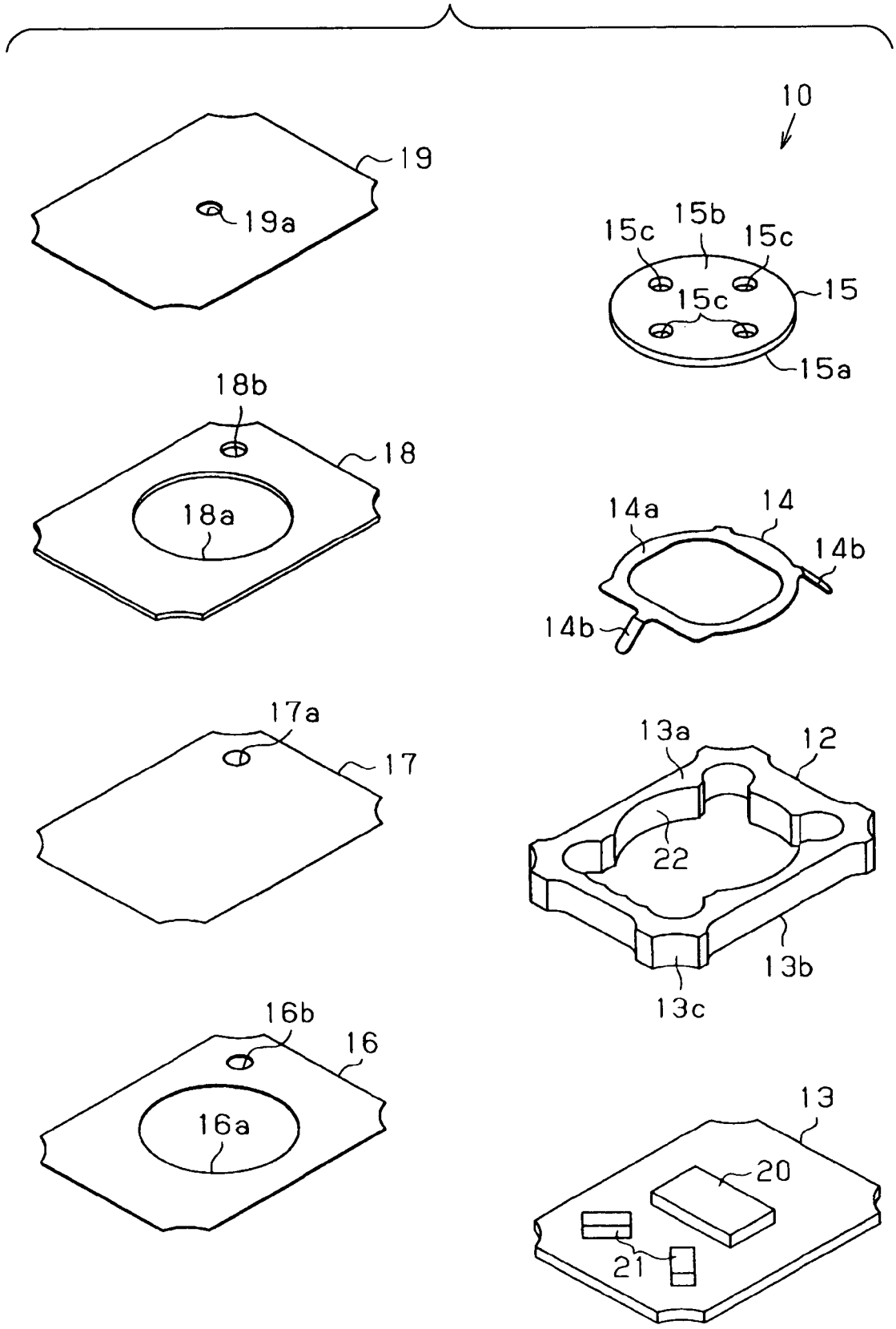
FIG. 3 is an exploded perspective view of the same.

As shown in FIG. 1, a condenser microphone 10 of this embodiment has a flat box shape of a substantially square in a top plan view. As shown in FIG. 2 and FIG. 3, the condenser microphone 10 is provided with a frame-shaped casing 12, a circuit board 13, a contact spring 14, a back plate 15, a spacer 16, a diaphragm 17, a diaphragm plate 18 and a cover 19.

The casing 12 is made of an electric insulator such as an epoxy resin, a liquid crystal polymer or ceramics to form the frame of the condenser microphone 10, and has a generally column-shaped hole 22 for forming an air chamber 23. As partially shown in FIG. 5, the casing 12 is provided on its upper and lower faces, respectively, with earthing conductive patterns 13*a* and 13*b*. The casing 12 is further provided on its side with a conductive pattern 13*c* for connecting the conductive patterns 13*a* and 13*b*. On the circuit board 13, there is configured an impedance conversion circuit, which is composed of a field effect transistor 20, a condenser 21 and so on. Moreover, the circuit board 13 is provided with an electric configuration such as an electrode pattern and a through hole, although not shown. The circuit board 13 is fixedly adhered to the lower face, as shown in FIG. 1, of the casing 12, and the impedance conversion circuit is arranged in each hole 22. The contact spring 14 is arranged in the hole 22 and on the circuit board 13. The contact spring 14 is integrally formed of a stainless steel sheet, and is composed of a support portion 14*a* of a generally annular sheet shape and three legs 14*b* extending obliquely downward and outward from the support portion 14*a*. Each leg 14*b* abuts against the not-shown land on the circuit board 13 so that it is electrically connected with the gate side of the field effect transistor 20 through this land. The support portion 14*a* supports the back plate 15 on its upper face.

The back plate 15 is formed into a disc shape having an outer diameter slightly smaller than the inner diameter of the hole 22 of the casing 12 so that it is held vertically movably in the hole 22. The back plate 15 is provided with a plate body 15*a* made of a stainless steel sheet, and this plate body 15*a* is covered on its upper face with an electret layer 15*b* formed of an FEP (Fluorinated Ethylene Propylene) film or the like. The electret layer 15*b* is polarized by a corona discharge. The back plate 15 is provided with a plurality of through holes 15*c*. The plate body 15*a* is connected through the contact spring 14 with the gate of the field effect transistor 20. The spacer 16 is fixedly adhered to the upper face of the casing 12. The spacer 16 is provided with a hole 16*a* having a smaller inner diameter than that of the hole 22 of the casing 12. With the lower face of the edge of the hole 16*a*, against the upper face of the outer circumference edge of the back plate 15 comes into contact. The contact spring 14 is clamped in an elastically deformed state between the circuit board 13 and the back plate 15. On the other hand, the back plate 15 is elastically pushed into contact with the lower face of the inner circumference edge of the spacer 16 by the elastic biasing force of the contact spring 14. The spacer 16 is made of a resin film of PET (PolyEthylene Terephthalate) or a metal sheet of stainless steel or the like.

The diaphragm 17 is fixedly adhered to the upper face of the spacer 16. The circuit board 13, the casing 12, the spacer 16 and the diaphragm 17 define the air chamber (as shown in FIG. 2) 23 isolated from the outside. The diaphragm plate 18 is fixedly adhered to the upper face of the diaphragm 17. The diaphragm plate 18 is provided with a hole 18*a* having an inner diameter substantially equal to that of the hole 16*a* of the spacer 16. The diaphragm 17 is clamped, at its portion excepting each hole 18*a*, between the spacer 16 and the diaphragm plate 18, and is spaced at a predetermined distance from the diaphragm 17 by the spacer 16. In other words, the back plate 15 and the diaphragm 17 constitute a condenser having a predetermined impedance. The diaphragm 17 can vibrate at its portion in the hole 18*a* of the diaphragm plate 18. The cover 19 is fixedly adhered to the upper face of the diaphragm plate 18. The cover 19 covers the diaphragm 17 in the hole 18*a* of the diaphragm plate 18 from the outside, and is provided with a sound hole 19*a* for establishing communications between the outside and the diaphragm 17.

Figure 5:
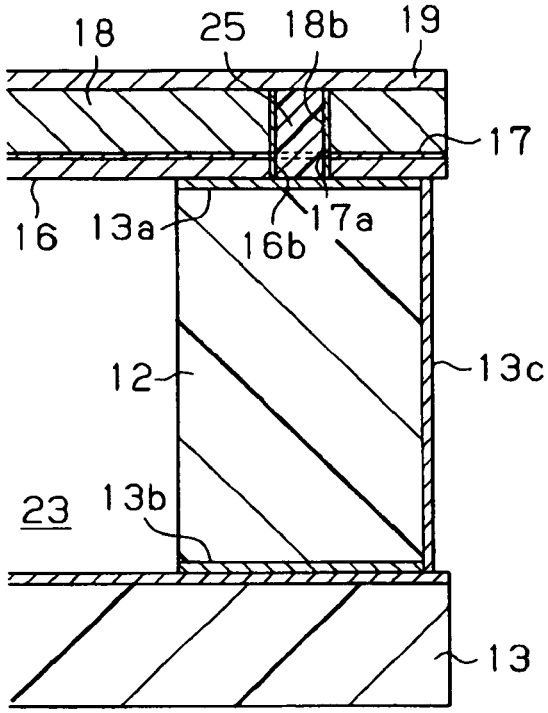
FIG. 5 is a longitudinal section of a portion of the condenser microphone and shows a through hole.

The spacer 16, the diaphragm 17 and the diaphragm plate 18 are provided with through holes 16*b*, 17*a* and 18*b*, respectively, which communicate with each other. As shown in FIG. 5, the diaphragm plate 18 is electrically connected through a conductive portion 25, which is made of a conductive adhesive or the like filling the individual through holes 18*b*, 17*a* and 16*b*, with the conductive pattern 13*a* of the casing 12. Moreover, the diaphragm plate 18 is electrically connected through the conductive patterns 13*a*, 13*c* and 13*b* with the earth on the circuit board 13.

In the condenser microphone 10 thus configured, the diaphragm 17 is vibrated through the sound hole 19*a* of the cover 19 by sound waves coming from a sound source. As the diaphragm 17 vibrates, the air freely migrates through the through holes 15*c* between the upper side and the lower side of the back plate 15 so that the vibrations of the diaphragm 17 are allowed. Then, the distance between the diaphragm 17 and the back plate 15 changes from a set value so that the impedance of the condenser changes according to the frequency, amplitude and waveform of the sound. This change of the impedance is converted into and outputted as voltage signals by the impedance conversion circuit.

Here is described the method for manufacturing the condenser microphone 10.

Figure 4:
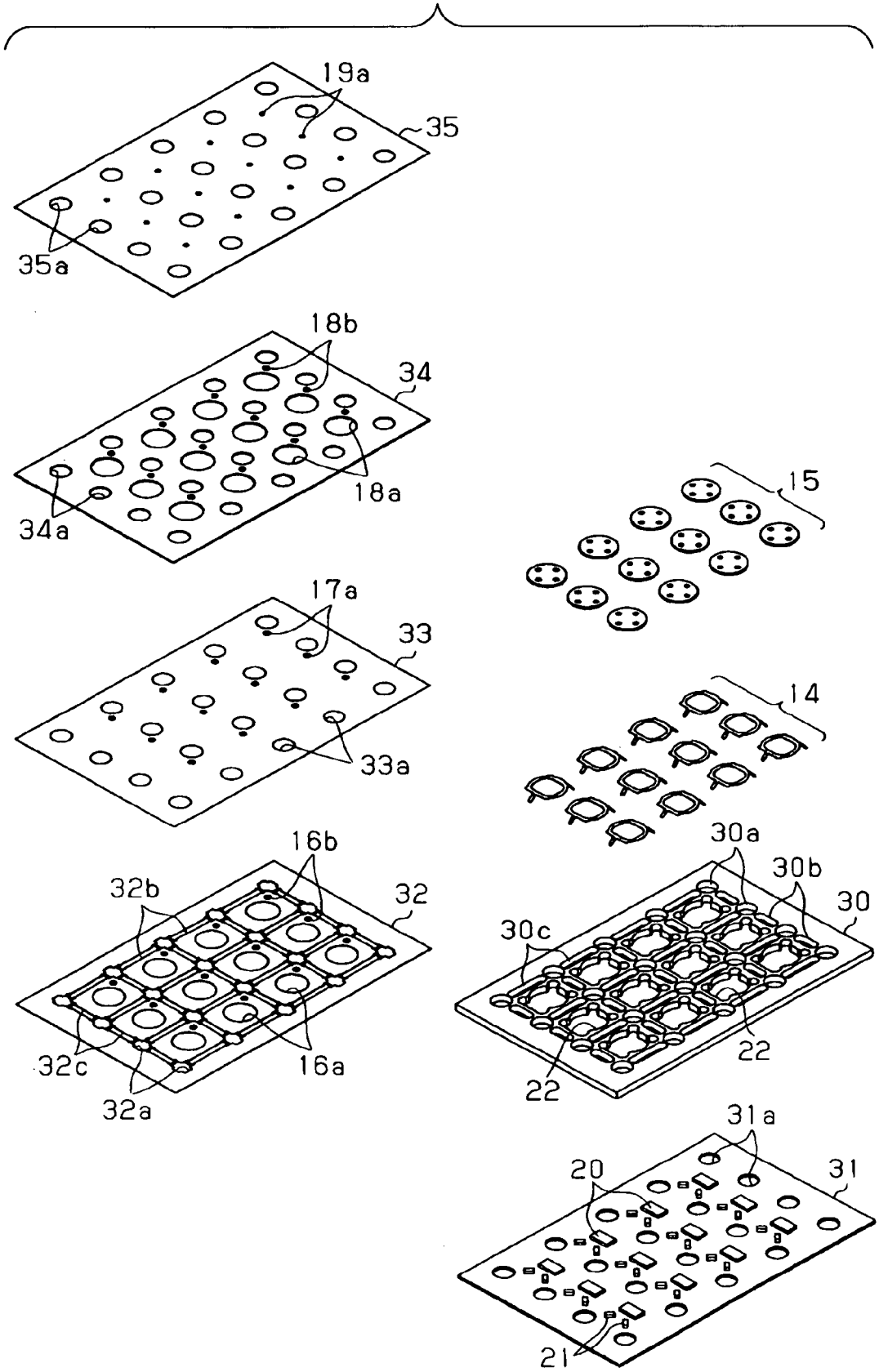
FIG. 4 is perspective views showing members to be used for manufacturing the condenser microphone.

In this manufacturing method, as shown in FIG. 4, a case forming member 30, a circuit board forming member 31, a spacer forming member 32, a diaphragm sheet 33, a diaphragm plate forming member 34, a cover forming member 35, the back plate 15, the contact spring 14 and so on are used to manufacture a plurality of condenser microphones 10.

Figure 6:
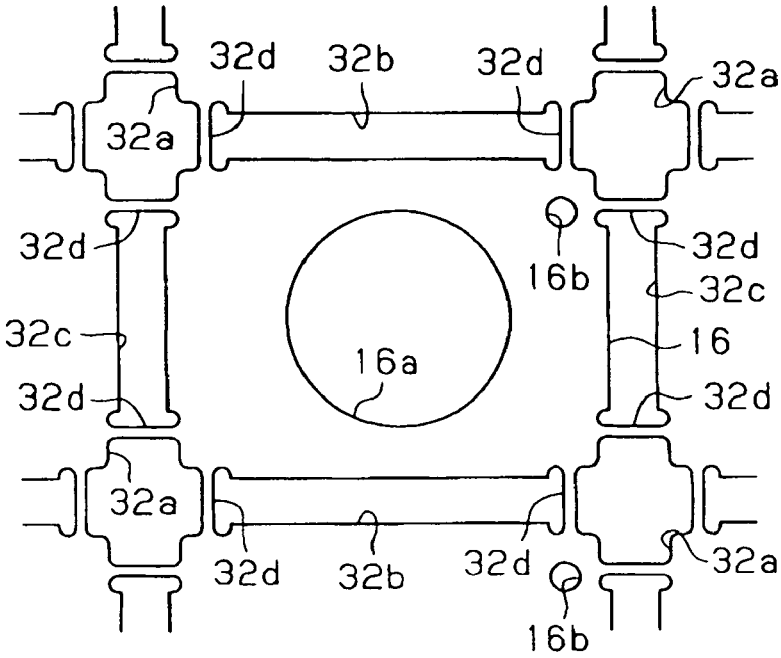
FIG. 6 is a top plan view showing a portion of a spacer forming member.

The case forming member 30 is a sheet material for forming a plurality of casings 12, and is provided with a plurality of holes 22 longitudinally and transversely at a predetermined pitch. The case forming member 30 is further provided with a plurality of holes 30*a*, a plurality of long holes 30*b* and a plurality of long holes 30*c* individually around the holes 22 at a predetermined pitch. The hole 30*a* is a through hole partially forming the conductive pattern 13*c*. The holes 30*a* and the long holes 30*b* and 30*c* are formed into through holes at the positions, which are cut at the later-described dicing step. The circuit board forming member 31 is an insulating board for forming a plurality of circuit boards 13, and is provided with a plurality of impedance conversion circuits longitudinally and transversely at a predetermined pitch. The circuit board forming member 31 is further provided with holes 31*a* of an equal diameter at every positions corresponding to the holes 30*a* of the case forming member 30. The spacer forming member 32 is a sheet material for forming a plurality of spacers 16, and is provided with a plurality of holes 16*a* longitudinally and transversely at a predetermined pitch. The spacer forming member 32 is provided, as shown in FIG. 6, with a plurality of through holes 32*a*, 32*b* and 32*c* for defining the individual spacers 16, the adjoining ones of which are connected to each other through bridges 32*d*. The individual holes 32*a*, 32*b* and 32*c* are formed at positions corresponding to the individual holes 30*a*, 30*b* and 30*c* of the case forming member 30. The diaphragm sheet 33 is a sheet material for forming a plurality of diaphragms 17. The diaphragm sheet 33 is provided with holes 33*a* of an equal diameter at every positions corresponding to the individual holes 30*a* of the case forming member 30. The diaphragm plate forming member 34 is a sheet material for forming a plurality of diaphragm plates 18, and is provided with a plurality of holes 18*a* longitudinally and transversely at a predetermined pitch. The diaphragm plate forming member 34 is provided with holes 34*a* of an equal diameter at every positions corresponding to the individual holes 33*a* of the diaphragm sheet 33.

Figure 7:
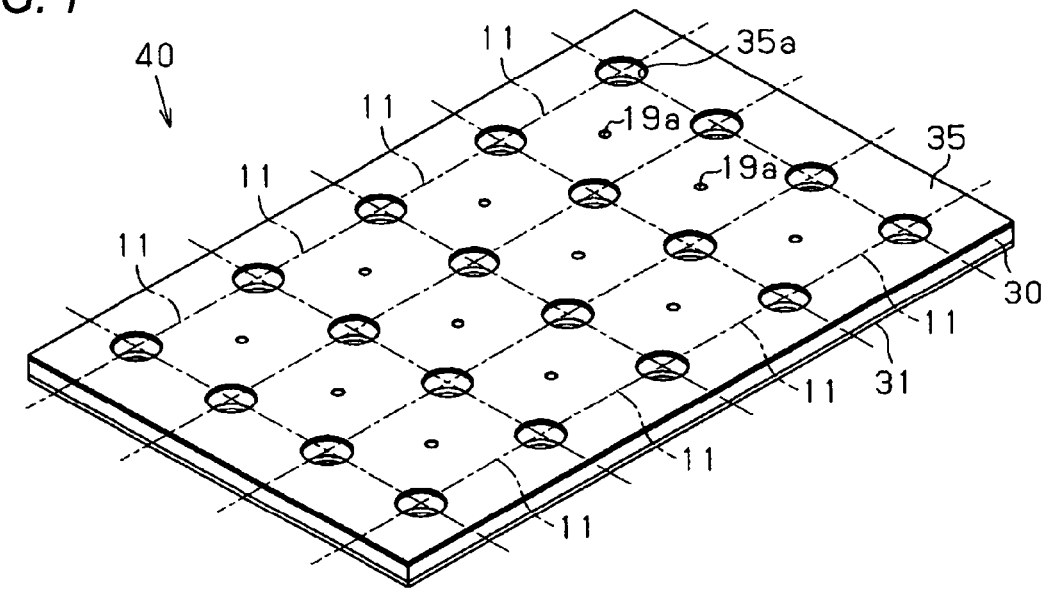
FIG. 7 is a perspective view showing a second microphone assembly.
Figure 8:
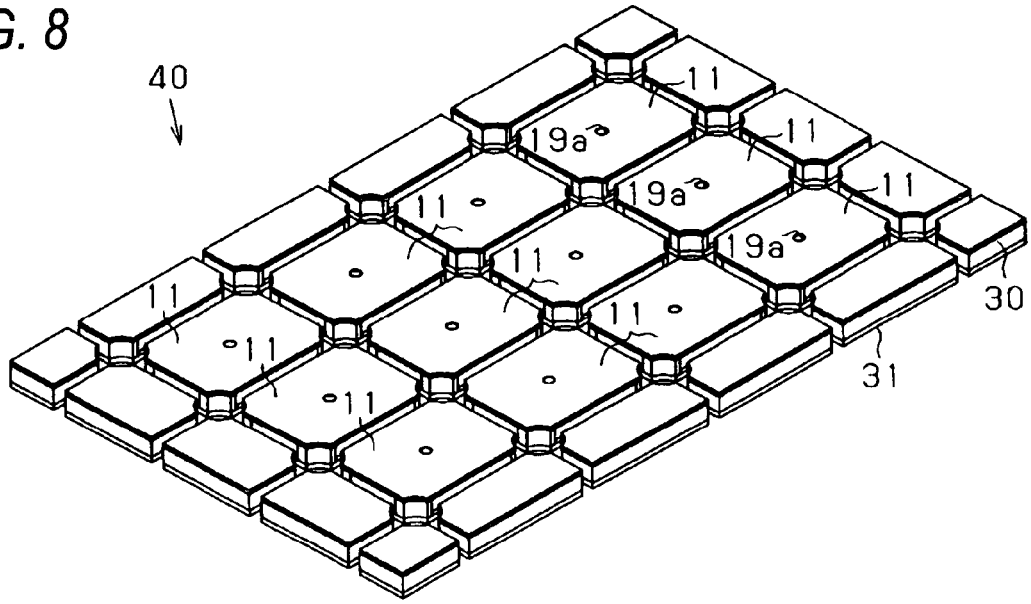
FIG. 8 is a perspective view showing the second microphone assembly after diced.

When the condenser microphone 10 is to be manufactured, the spacer forming member 32 and the diaphragm plate forming member 34 are laminated with the diaphragm sheet 33 between, and these three laminated members are integrally adhered into a diaphragm assembly. At this time, the tension of the diaphragm sheet 33 is properly set between the holes 16*a* of the spacer forming member 32 and the holes 18*a* of the diaphragm plate forming member 34. On the other hand, the circuit board forming member 31 is integrally adhered to the case forming member 30 thereby to integrate the two into a casing assembly. Next, the contact spring 14 and the back plate 15 are then assembled sequentially in the recited order into the hole 22 of the case forming member 30 in that casing assembly. Next, the diaphragm assembly is adhered to the upper face of that casing assembly thereby to integrate the two into a microphone assembly. Next, the cover forming member 35 is adhered to the upper face of that microphone assembly thereby to integrate the two. As shown in FIG. 7, a laminate 40 thus formed is composed of a plurality of condenser microphone constituting bodies 11. At last, as shown in FIG. 8, that laminate 40 is diced (or cut) with a diamond blade to separate the condenser microphone constituting bodies 11 individually for the condenser microphones 10. At this time, the thickest case forming member 30 made of the epoxy resin, the liquid crystal polymer or the ceramics is cut at the portions of the holes 30*a* and the long holes 30*b* and 30*c*, as juxtaposed around the holes 22, so that the cutting resistance at the dicing step is lowered. Moreover, the spacer forming member 32 made of the resin film of PET or the metal sheet of stainless steel is cut at the portions of the individual through holes 32*a* to 32*c*, so that the cutting resistance is further lowered.

For convenience of description, FIG. 4, FIG. 7 and FIG. 8 show the state, in which condenser microphone constituting bodies 11 of 3×4=12 are formed. As a matter of fact, several hundreds of condenser microphone constituting bodies 11 are formed at a time.

In this embodiment, the conductive portions 25 are formed by filling the individual through holes 18*b*, 17*a* and 16*b* with the conductive adhesive, but may also be configured by fitting metal pins or springs in the individual through holes 18*b*, 17*a* and 16*b*.

According to the method of this embodiment for manufacturing the condenser microphone 10, the circuit board forming member 31, the case forming member 30, the spacer forming member 32, the diaphragm sheet 33 and the diaphragm plate forming member 34 are laminated sequentially in the recited order. Moreover, the laminate 40 having a plurality of condenser microphone constituting bodies 11 is formed by arranging the back plates 15 and the contact springs 14 in the air chambers 23 formed by the individual forming members. This laminate 40 is diced to separate the individual condenser microphone constituting bodies 11 so that the individual condenser microphone constituting bodies 11 are adopted as the condenser microphones 10. Therefore, the productivity is improved better than conventional manufacturing method, in which the condenser microphones are manufactured one by one.

In the air chamber 23 of each condenser microphone constituting body 11, moreover, the back plate 15 is elastically biased by the contact spring 14 so that it is held in abutment against the spacer 16. When the heat resulting from the reflow soldering operation is applied to the condenser microphone 10, the force, as applied due to the difference in the thermal expansion coefficient to the condenser microphone 10, is absorbed by the elastic deformation of the contact spring 14 so that it is not applied to the spacer 16. As a result, the spacer 16 is not deformed to have its thickness reduced, and the distance between the back plate 15 and the spacer 16 does not become less than the set value so that the sensitivity characteristics are not degraded.

Moreover, the spacer forming member 32 has a plurality of through holes 32*a* to 32*c* defining the individual spacers 16, and is cut at the portions of the individual through holes 32*a* to 32*c* when the laminate 40 is diced. As a result, the cutting resistance at the time of dicing the laminate 40 is reduced to facilitate the dicing operation so that the productivity of the condenser microphone 10 is improved far better.

Moreover, the thickest case forming member 30 has a plurality of holes 30*a* to 30*c* around the holes 22, and is cut at the portions of the individual holes 30*a* to 30*c* when the laminate 40 is diced. As a result, the cutting resistance at the time of dicing the laminate 40 is reduced to facilitate the dicing operation so that the productivity of the condenser microphone 10 is improved far better.

Moreover, the individual through holes 32*a* to 32*c* of the spacer forming member 32 and the individual holes 30*a* to 30*c* of the case forming member 30 are formed in the laminate 40 at the mutually corresponding positions. Therefore, the dicing operation of the laminate 40 is more facilitated to improve the productivity far better.

Moreover, the diaphragm sheet 33 is clamped between the spacer forming member 32 and the diaphragm plate forming member 34, and they are laminated and integrated. After this, this diaphragm assembly and the case forming member 30 are adhered and integrated. As a result, the adjustment of the tension of the diaphragm sheet 33 is made easier than the case, in which those individual members are laminated and integrated at a time. Therefore, the manufacture of the condenser microphone 10 is more facilitated.

Moreover, all of the casing 12, the circuit board 13, the spacer 16, the diaphragm plate 18 and the cover 19 are made of the epoxy resin, the liquid crystal polymer or the ceramics other than a metal member. As a result, the cutting resistance at the time of dicing the laminate 40 is reduced to facilitate the dicing operation so that the productivity is improved far better.

This embodiment can be modified in the following manners.

(1) At the time of manufacturing the condenser microphone 10, the microphone assembly in the state having no cover forming member 35 laminated may be diced to produce the condenser microphone 10 having no cover 19. The condenser microphone 10 is completed by fixedly adhering the cover 19 thereto.

Figure 9:
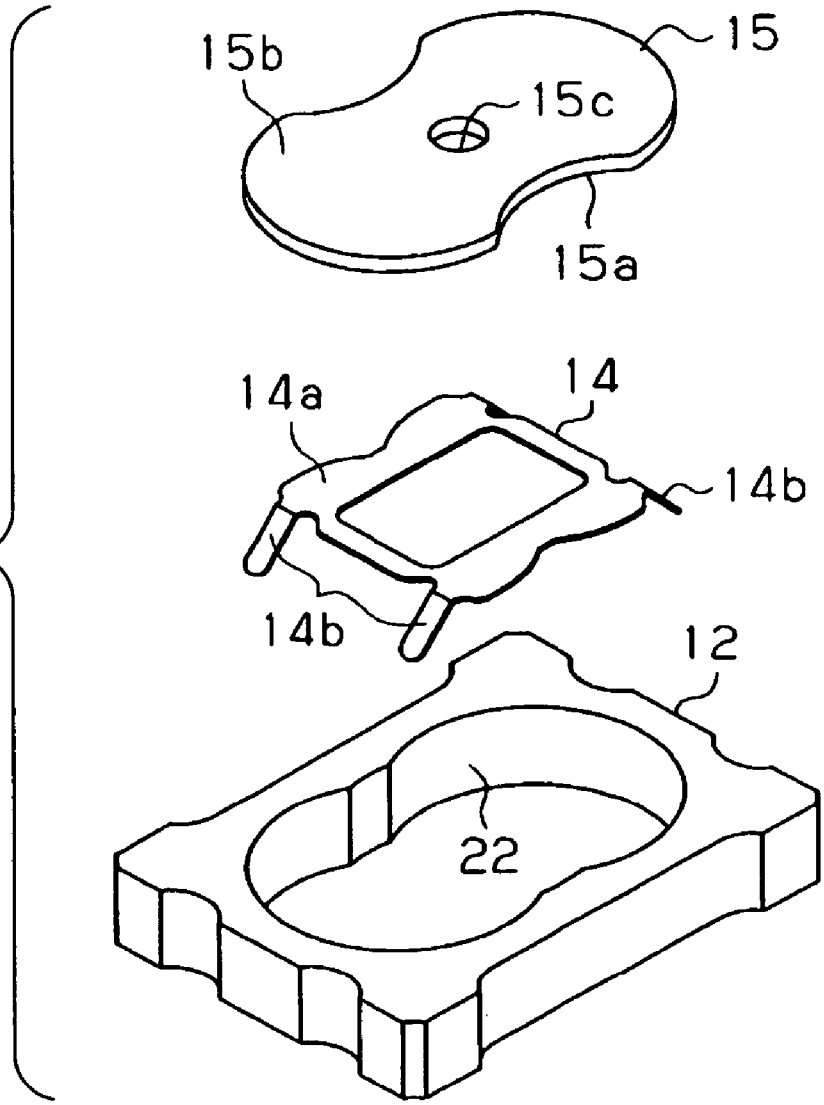
FIG. 9 is an exploded perspective views of a portion in a condenser microphone according to a modified embodiment.

(2) As shown in FIG. 9, the condenser microphone may be configured by using the back plate 15 of a substantial cocoon shape in a top plan view, and the casing 12 having the hole 22 of a substantial cocoon shape. In this case, the contact spring 14 is composed of the support portion 14*a* of a substantial square shape and the four legs 14*b* formed at the four corners of that support portion 14*a*.

(3) This invention is applicable to an electret condenser microphone of a foil electret type, in which the function of the electret is given to the diaphragm 17 in place of the back plate 15.

(4) This invention is applicable to a charge pump type condenser microphone, in which the electret function is given to neither the back plate 15 nor the diaphragm 17 but in which the voltage is applied to the back plate 15 and the diaphragm 17 by a charge pump circuit.

The technical concept for grasping the foregoing embodiment better is described in the following.

A condenser microphone including: a case forming member having a plurality of holes for forming air chambers individually; a circuit board forming member having a plurality of impedance conversion circuits corresponding to the individual air chambers; a spacer forming member 32 for forming a plurality of spacers corresponding to the individual air chambers; a diaphragm sheet for forming a plurality of diaphragms corresponding to the individual spacers; and a diaphragm plate forming member for forming a plurality of diaphragm plates corresponding to the individual diaphragms. The condenser microphone is characterized by: laminating the circuit board forming member, the case forming member, the spacer forming member, the diaphragm sheet and the diaphragm plate forming member; arranging, for each of the air chambers formed by the lamination, the back plate and the contact spring for elastically biasing the back plate to hold the back plate in abutment against the spacer forming member and for conducting the back plate with the impedance conversion circuits; jointing the individual laminated members integrally to form a laminate composed of a plurality of condenser microphone constituting bodies; and cutting the laminate to separate the individual condenser microphone constituting bodies.

A second embodiment of this invention as a back electret type condenser microphone will be described with reference to FIG. 10 to FIG. 14.

Figure 10:
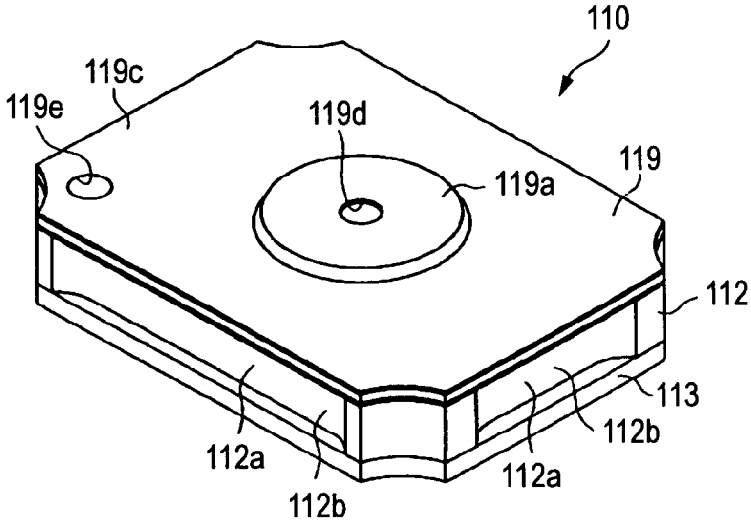
FIG. 10, is a perspective view showing a condenser microphone according to a second embodiment.
Figure 11:
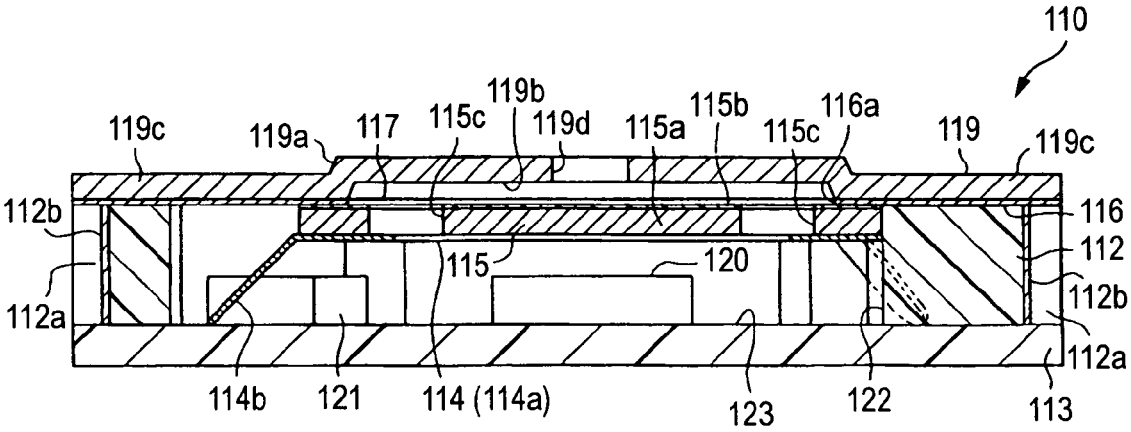
FIG. 11 is a longitudinal section showing the condenser microphone.
Figure 12:
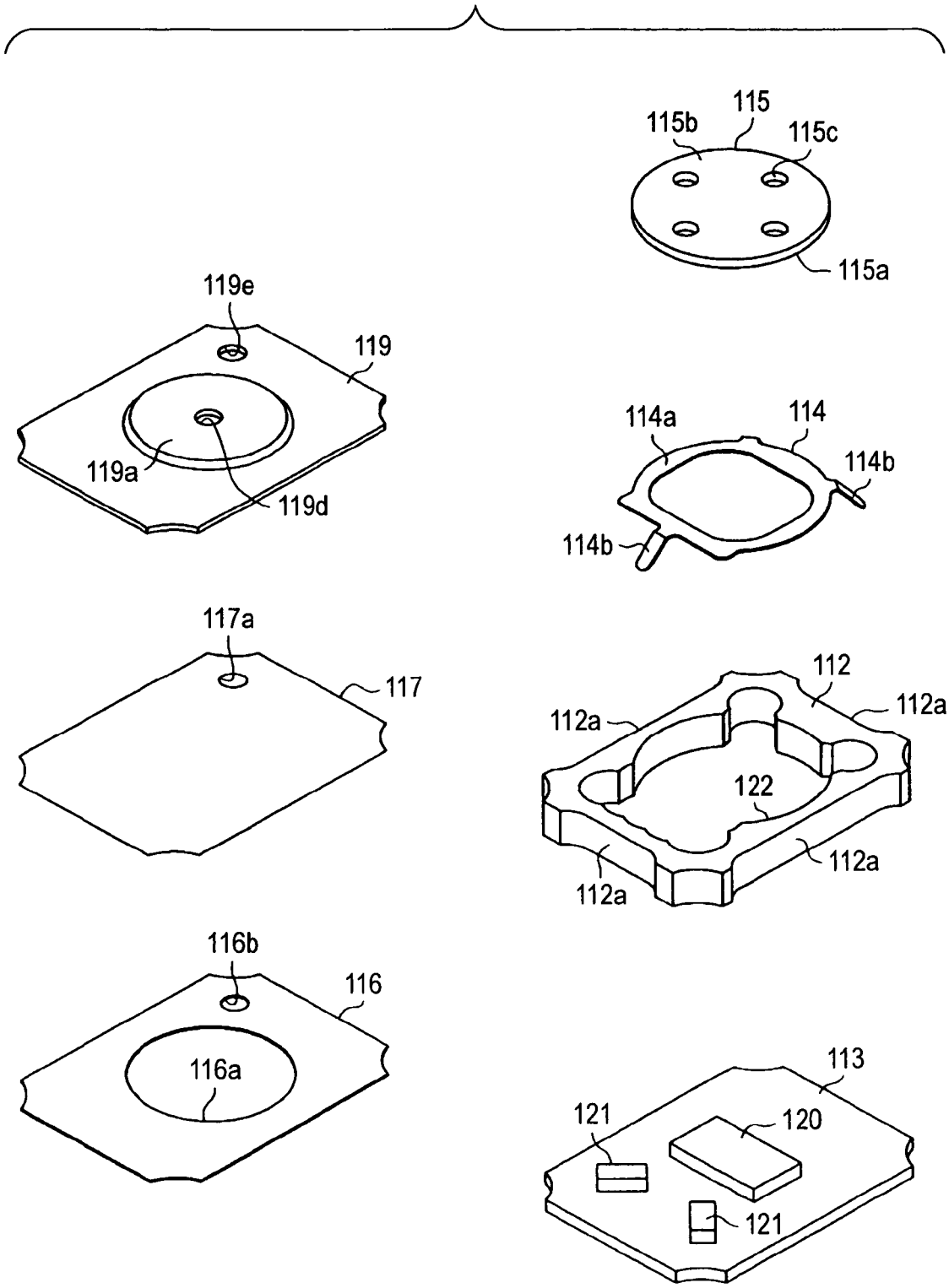
FIG. 12 is an exploded perspective view of the same.

As shown in FIG. 10 to FIG. 12, a condenser microphone 110 is provided with a frame-shaped casing 112, a circuit board 113, a contact spring 114, a back plate 115, a spacer 116, a diaphragm 117, and a cover 119.

Figure 14:
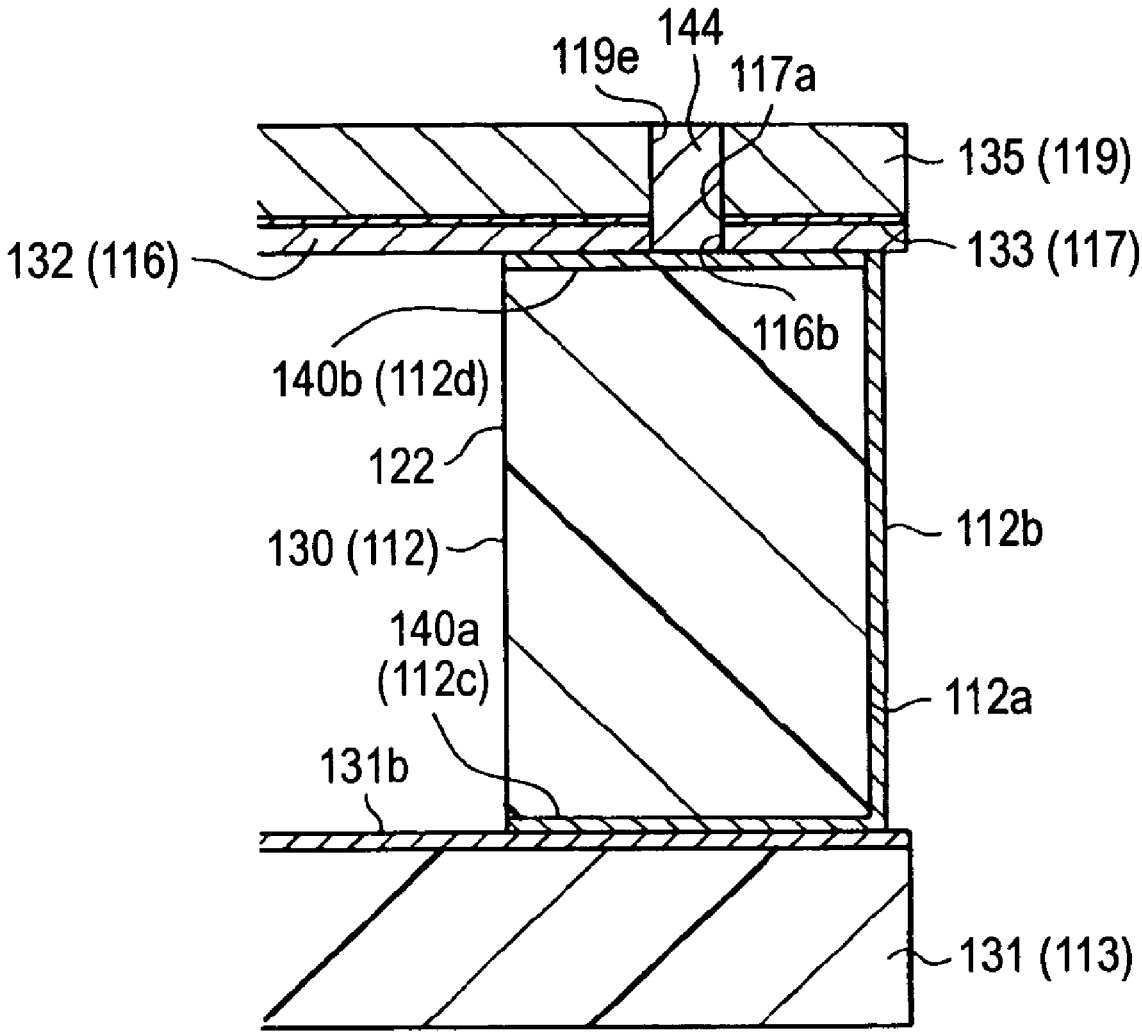
FIG. 14 is a section of a main portion of the condenser microphone.

The casing 112 forms the frame of the condenser microphone 110, and has a generally column-shaped hole 122 for forming an air chamber 123. The casing 112 is made of an electric insulator such as an epoxy resin, a liquid crystal polymer or ceramics. On the circuit board 113, there is configured an impedance conversion circuit, which is composed of a field effect transistor 120, a condenser 121 and so on. The field effect transistor 120 and the condenser 121 correspond to the impedance conversion elements. Moreover, the circuit board 113 is provided with an electric configuration such as an electrode pattern and a through hole, although not shown. The electronic circuit board 113 is fixedly adhered by a conductive adhesive to the lower face, as shown in FIG. 11, of the casing 112 of the general frame shape, and the impedance conversion circuit is arranged in the hole 122. In FIG. 14, a conductive layer 112*c* is formed of the conductive adhesive on the electronic circuit board 113 and the casing 112.

The contact spring 114 is arranged in the hole 122 and on the circuit board 113. The contact spring 114 is integrally formed of a stainless steel sheet, and is composed of a support portion 114*a* of a generally annular sheet shape and three legs 114*b* extending obliquely downward and outward from the support portion 114*a*. Each leg 114*b* abuts against the not-shown land on the circuit board 113 so that it is electrically connected with the impedance conversion circuit through this land. The support portion 114*a* supports the back plate 115 on its upper face. The back plate 115 corresponds to the back electrode plate.

The back plate 115 is formed into a disc shape having an outer diameter slightly smaller than the inner diameter of the hole 122 of the casing 112 so that it is held vertically movably in the hole 122. The back plate 115 is provided with a plate body 115*a* made of a stainless steel sheet, and this plate body 115*a* is covered on its upper face with an electret layer 115*b* of an FEP (Fluorinated Ethylene Propylene) film or the like. The electret layer 115*b* is polarized by a corona discharge. The back plate 115 is provided with a plurality of through holes 115*c*. The plate body 115*a* of the back plate 115 is electrically connected through the contact spring 114 with the impedance conversion circuit.

The spacer 116 is fixedly adhered by a conductive adhesive to the upper face of the casing 112. In FIG. 14, a conductive layer 112*d* is formed of that conductive adhesive on the spacer 116 and the casing 112. The spacer 116 is provided with a hole 116*a* having a smaller inner diameter than that of the hole 122 of the casing 112, and abuts, at the lower face of the edge of the hole 116*a*, against the upper face of the outer circumference edge of the back plate 115. The contact spring 114 is clamped in an elastically deformed state between the electronic circuit board 113 and the back plate 115. On the other hand, the back plate 115 is elastically pushed into contact with the lower face of the inner circumference edge of the spacer 116 by the elastic biasing force of the contact spring 114. Further, in the spacer 116, near the side edge thereof, a through hole 116*b* is formed. The spacer 116 is made of a resin film of PET (PolyEthylene Terephthalate) or a metal sheet of stainless steel or the like.

The diaphragm 117 is fixedly adhered to the upper face of the spacer 116. The diaphragm 117 is a vibrating film. The diaphragm 117 is provided, at a position corresponding to the through hole 116*b*, with a through hole 117*a* having a diameter equal to that of the through hole 116*b*. The casing 112, the electronic circuit board 113, the spacer 116 and the diaphragm 117 form the air chamber 123 partitioned off the outside (refer to FIG. 11).

As shown in FIG. 11, the cover 119 of a metal sheet is fixedly adhered to the upper face of the diaphragm 117. The cover 119 corresponds to a cover member. The cover 119 is etched in a single-sided manner on its upper and lower faces to form a low frusto-conical land 119*a* at the center of the upper face and to form a recess 119*b* of such a circular section in the lower face corresponding to the land 119*a* as has an inner diameter substantially equal to that of the hole 116*a* of the spacer 116. The recess 119*b* is set to a depth of about 0.15 mm in this embodiment. However, the depth should not be limited to that numerical value but may be any so long as the diaphragm 117 can vibrate.

In the cover 119, on the other hand, the portion, as fixedly adhered to the diaphragm 117, is a tensing portion 119*c*. A predetermined tension is applied to the diaphragm 117 by that tensing portion 119*c*. The cover 119 also acts as a protecting portion for covering the diaphragm 117 as a whole. Thus, the cover 119 is configured to have the tensing portion 119*c* and the protecting portion integrally. In the tensing portion 119*c*, moreover, a through hole 119*e* of the same diameter as that of the through hole 117*a* is formed at a position corresponding to the through hole 117*a*.

Thus, the diaphragm 117 is clamped, at its portion excepting the recess 119*b*, between the spacer 116 and the cover 119, and the distance from the cover 119 is set to a predetermined value by the spacer 116. In short, the back plate 115 and the diaphragm 117 constitute a condenser having a predetermined impedance. Moreover, the diaphragm 117 can vibrate at its portion in the recess 119*b* of the cover 119. As shown in FIG. 10 and FIG. 11, the cover 119 is provided in its upper face with a sound hole 119*d* for communicating the outside and the diaphragm 117. Here, this embodiment is provided with one sound hole 119*d* but may be provided with a plurality of sound holes.

As shown in FIG. 14, the respective through holes 119*e*, 117*a* and 116*b* of the cover 119, the diaphragm 117 and the spacer 116 are filled with a conductive material 144 such as a conductive adhesive or conductive paste, through which the conductive layer 112*d* is electrically connected with the cover 119.

A conductive layer 112*b* is disposed in a recess 112*a* formed in the outer side face of the casing 112. The conductive layer 112*b* is formed by applying a conductive coating material such as a conductive adhesive or conductive paste. The conductive layers 112*c* and 112*d* are electrically connected through that conductive layer 112*b*. As a result, the cover 119 is electrically connected through the conductive layers 112*d*, 112*b* and 112*c* with an electrode pattern 131*b* on the earth side on the electronic circuit board 113. Moreover, the electric circuit in the casing 112 is electromagnetically shielded by the conductive layer 112*b* covering most of the side face of the casing 112 and the cover 119 covering the top of the casing 112.

In the condenser microphone 110 thus configured, the diaphragm 117 is vibrated through the sound hole 119*d* of the cover 119 by sound waves coming from a sound source. As the diaphragm 117 vibrates, the air freely migrates through the through holes 115*c* between the upper side and the lower side of the back plate 115 so that the vibrations of the diaphragm 117 are allowed. Then, the distance between the diaphragm 117 and the back plate 115 changes from a set value so that the impedance of the condenser changes according to the frequency, amplitude and waveform of the sound. This change of the impedance is converted into and outputted as voltage signals by the impedance conversion circuit.

The manufacture of the condenser microphone 110 will be briefly explained.

The condenser microphone 110 is formed by separating an assembly, which was prepared by laminating a plurality of assembling members.

Figure 13:
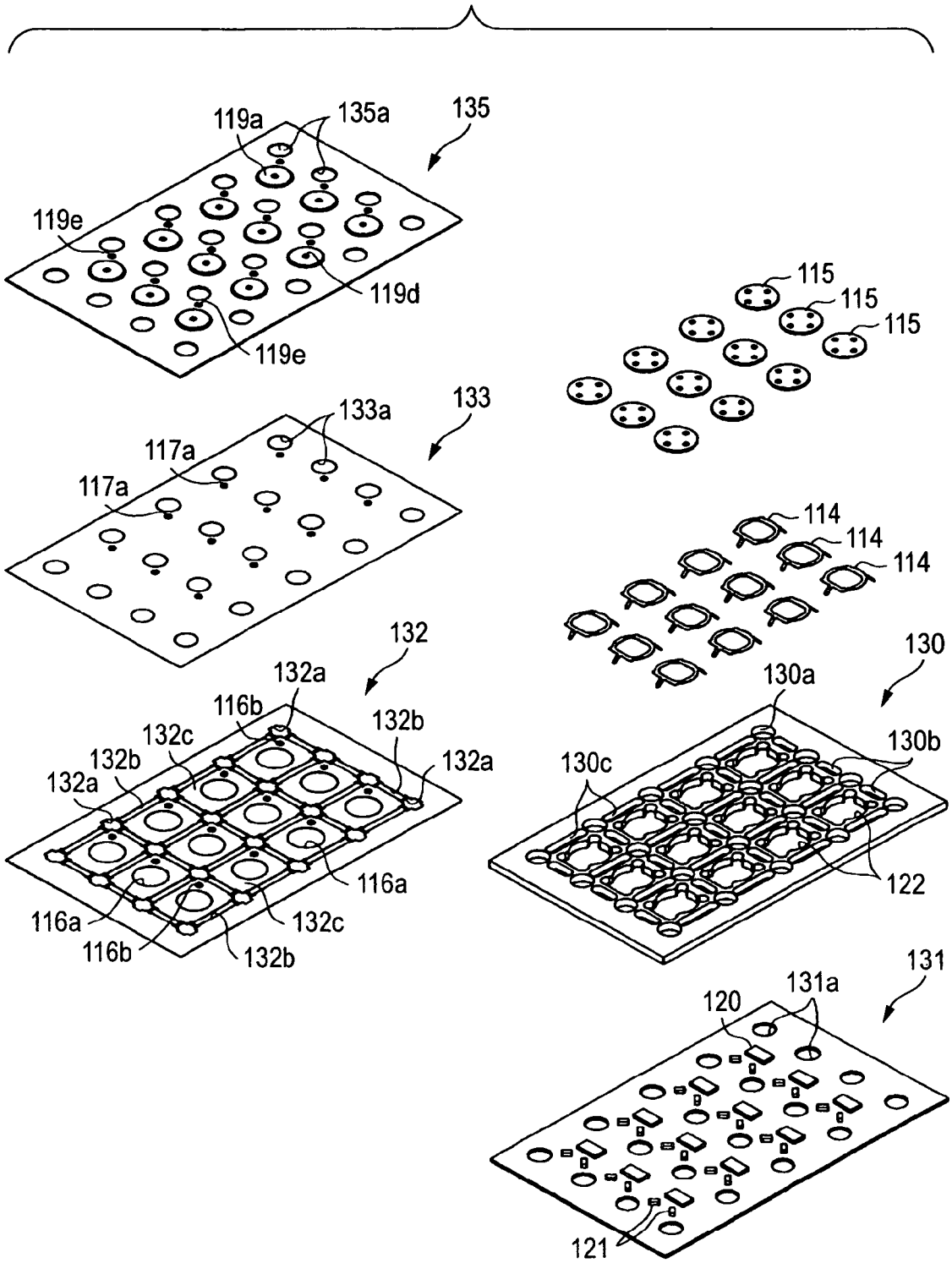
FIG. 13 is perspective views showing members to be used for manufacturing the condenser microphone.

In this manufacturing method, as shown in FIG. 13, a case forming member 130, a circuit board forming member 131, a spacer forming member 132, a diaphragm sheet 133, a cover forming member 135, the back plate 115, the contact spring 114 and so on are used to manufacture a plurality of condenser microphones 110.

The case forming member 130 is a sheet material as an assembling member for forming a plurality of casings 112, and is provided with a plurality of holes 122 longitudinally and transversely at a predetermined pitch. The case forming member 130 is further provided with a plurality of holes 130*a*, a plurality of long holes 130*b* and a plurality of long holes 130*c* individually around the holes 122 longitudinally and transversely at a predetermined pitch. A conductive adhesive or conductive paste either fills up or is applied to the inner faces of those long holes 130*b* and long holes 130*c*. The long hole 130*b* and the long hole 130*c* form, after diced as will be described hereinafter, the recess 112*a* of the casing 112, and the conductive adhesive or conductive paste, as filled in or applied to the long hole 130*b* and the long hole 130*c*, forms the conductive layer 112*b*. The circuit board forming member 131 is an insulating board as an assembling member for forming a plurality of circuit boards 113, and is provided with a plurality of impedance conversion circuits longitudinally and transversely at a predetermined pitch. The circuit board forming member 131 is further provided with holes 131*a* of an equal diameter at every positions corresponding to the holes 130*a* of the case forming member 130.

The spacer forming member 132 is a sheet material as an assembling member for forming a plurality of spacers 116, and is provided with a plurality of holes 116*a* and a plurality of through holes 116*b* longitudinally and transversely at a predetermined pitch. The spacer forming member 132 is provided with a plurality of holes 132*a* and a plurality of long holes 132*b* at a predetermined pitch thereby to enclose the four sides of each hole 116*a*. In the portion surrounded by the holes 132*a* and the long holes 132*b*, an island member 132*c* is formed.

The diaphragm sheet 133 is a sheet member as an assembling member for forming a plurality of diaphragms 117. The diaphragm sheet 133 is provided with holes 133*a* at every positions corresponding to the individual holes 132*a* of the spacer forming member 132. The diaphragm sheet 133 is further formed with the through holes 117*a* at positions corresponding to the individual through holes 116*b* of the spacer forming member 132.

The cover forming member 135 is a metal sheet as an assembling member for forming a plurality of covers 119, and is provided with a plurality of lands 119*a* and a plurality of recesses 119*b*, respectively, on the two upper and lower faces and longitudinally and transversely at a predetermined pitch. The cover forming member 135 is further provided with holes 135*a* of an equal diameter at every positions corresponding to the individual holes 133*a* of the diaphragm sheet 133. On the other hand, each land 119*a* is provided with the sound hole 119*d*. The cover forming member 135 is further provided with the through holes 119*e* at positions corresponding to the individual through holes 117*a* of the diaphragm sheet 133.

When the condenser microphone 110 is to be manufactured, the spacer forming member 132 and the cover forming member 135 are laminated through the diaphragm sheet 133, and these three laminated members are integrally adhered into a diaphragm assembly. On the other hand, the circuit board forming member 131 is integrally adhered to the case forming member 130 by a conductive adhesive thereby to integrate the two into a casing assembly. In the circuit board forming member 131 of this case, as shown in FIG. 14, at the portion divided later into the electronic circuit board 113, the lower face of the side wall of the portion, as divided later into the casing 112, in the case forming member 130 is adhered by the conductive adhesive to the electrode pattern 131*b*, as becoming the earth side, of the electronic circuit of the electronic circuit board 113. In FIG. 14, a conductive layer 140*a* is formed with the conductive adhesive between the circuit board forming member 131 and the case forming member 130.

Next, the contact spring 114 and the back plate 115 are then individually assembled sequentially in the recited order into each hole 122 of the case forming member 130 in that casing assembly. Next, the diaphragm assembly is adhered by a conductive adhesive to the upper face of that casing assembly thereby to integrate the two into a microphone assembly. In the spacer forming member 132 of this case, as shown in FIG. 14, the lower faces of the four peripheral edges of the portion divided later into the spacer 116 are adhered by the conductive adhesive to the upper faces of the side walls of the portion, as divided later into the casing 112, of the case forming member 130. In FIG. 14, a conductive layer 140*b* is formed of the conductive adhesive between the spacer forming member 132 and the case forming member 130.

The characteristics of the condenser microphone 110 thus configured are described in the following.

This embodiment is provided with the cover 119, in which the tensing portion 119*c* for tensing the diaphragm 117 and the protecting portion arranged to cover and protect the diaphragm 117 are integrally formed. Therefore, the single member of the cover 119 can protect the diaphragm 117 and can tense the diaphragm 117. As a result, it is unnecessary unlike the prior art to prepare the individual members for protecting the diaphragm 117 and for tensing the diaphragm 117, so that the number of parts can be reduced to lower the cost.

In this embodiment, the cover 119 is formed of the metal sheet. Especially by single-sided etching the two upper and lower faces of the metal sheet, it is possible to easily form the recess 119*b* for allowing the vibrations of the diaphragm 117.

In this embodiment, the land 119*a* is formed on the upper face of the center of the cover 119 so that the rigidity of the cover 119 can be raised to enhance the protecting function. Here, the recess 119*b* may be formed by etching only the lower face of the center of the cover 119 thereby to form the tensing portion 119*c*. Moreover, the cover 119 may also be pressed to form the recess 119*b*.

Figure 15:
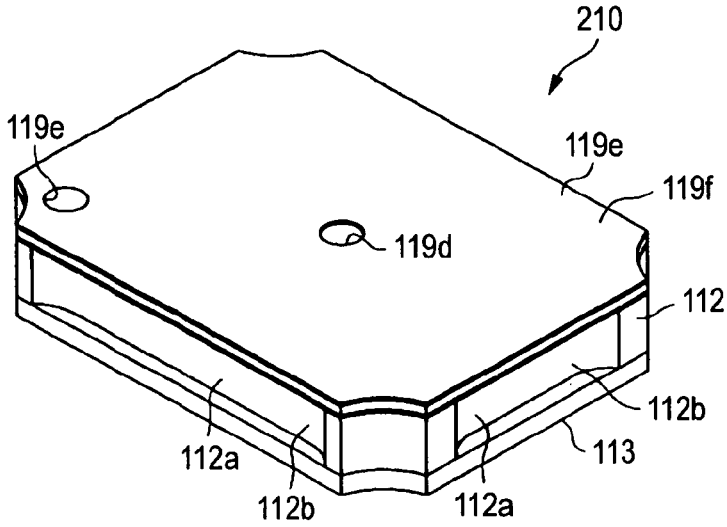
FIG. 15 is a perspective view of a condenser microphone according to a third embodiment.
Figure 16:
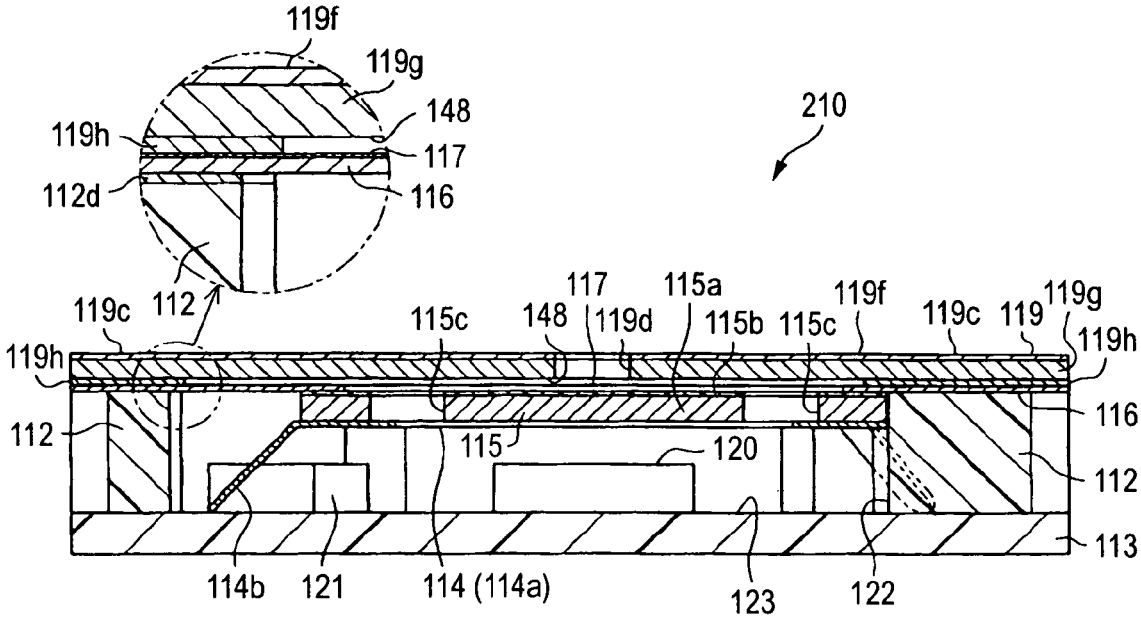
FIG. 16 is a longitudinal section of the same.

Now, a third embodiment will be described with reference to FIG. 15 and FIG. 16. Here, the configurations identical or corresponding to those of the second embodiment are omitted in their description by designating them by the common reference numerals, and the description is made here on the different configurations.

The cover 119 is formed of the metal sheet in the second embodiment, but is configured of a circuit board in place of the metal sheet in a condenser microphone 210 of the third embodiment. This circuit board is provided with a glass-epoxy layer 119*g* as an insulating layer and a metal layer 119*f* as a conductive layer formed all over the glass-epoxy layer 119*g*. The circuit board is further provided, at the portion, as corresponding to the casing 112 and becoming the tensing portion 119*c*, of the lower face of the glass-epoxy layer 119*g*, with a metal layer 119*h* as an electrode pattern layer formed in a predetermined pattern (as referred to FIG. 16). The metal layers 119*f* and 119*h* can be formed of a copper layer or an aluminum layer, for example. The metal layer 119*h* has a thickness of about several tens microns, for example. This thickness of the metal layer 119*h* forms such a recess 148 at the center portion of the cover 119 (or the circuit board) having no metal layer 119*h* as allows the vibrations of the diaphragm 117. Here, the thickness of the metal layer 119*h* should not be limited to that value of several tens microns, but may be any so long as the diaphragm 117 can vibrate in the recess 148.

In the metal layer 119*h*, although not shown, the through hole 119*e* of the cover 119 is filled with the conductive material 144 such as the conductive adhesive or the conductive paste. By the constitution similar to that of this embodiment, moreover, the cover 119 is electrically connected with the electrode pattern 131*b* of the electronic circuit board 113 through the conductive layers 112*d*, 112*b* and 112*c* (refer to FIG. 14), which are formed on predetermined faces of the casing 112. With this configuration of the third embodiment, the electric circuit in the casing 112 is electromagnetically shielded by the conductive layer 112*b* covering most of the sides of the casing 112 and the cover 119 covering the upside of the casing 112.

The condenser microphone 210 thus configured has the following characteristics in addition to the advantage of the second embodiment.

In this embodiment, the cover 119 is formed of the circuit board. Especially, the metal layer 119*f* can be applied as the electromagnetically shielding means so that no special member need be prepared for the electromagnetic shielding.

In this embodiment, the cover 119 has the metal layer 119*h* on the lower face of the tensing portion 119*c*. Moreover, the metal layer 119*h* is eliminated by the etching operation or the like at the board manufacturing step so that the recess 148 necessary for vibrating the diaphragm 117 can be easily formed in the cover 119.

Here, the foregoing embodiments can be modified in the following manners.

(1) In the second embodiment, the land 119*a* and the recess 119*b* are formed by the single-sided etching operation but may also be formed by a drawing operation such as a pressing operation.

(2) The configurations of the second embodiment and the third embodiment are embodied into an electret condenser microphone of a foil electret type, in which the function of the electret is given to the diaphragm 117 in place of the back plate 115.

(3) The configurations of the second embodiment and the third embodiment are embodied into a charge pump type condenser microphone, in which the electret function is given to neither the back plate 115 nor the diaphragm 117 but in which the voltage is applied to the back plate 15 and the diaphragm 117 by a charge pump circuit.

(4) In the configuration of the second embodiment, the land 19*a* is formed into the low frusto-conical land but may also be formed into a dome shape.

What is claimed is:

1. A method for manufacturing a condenser microphone using:

a case forming member having a plurality of holes for forming air chambers individually;

a circuit board forming member having a plurality of impedance conversion circuits corresponding to the individual air chambers;

a spacer forming member for forming a plurality of spacers corresponding to the individual air chambers;

a diaphragm sheet for forming a plurality of diaphragms corresponding to the individual spacers; and a diaphragm plate forming member for forming a plurality of diaphragm plates corresponding to the individual diaphragms, the method comprising:

laminating the circuit board forming member, the case forming member, the spacer forming member, the diaphragm sheet and the diaphragm plate forming member; arranging, for each of the air chambers formed by the lamination, the back plate and the contact spring for elastically biasing the back plate to hold the back plate in abutment against the spacer forming member and for conducting the back plate with the impedance conversion circuits; jointing the individual laminated members integrally to form a laminate composed of a plurality of condenser microphone constituting bodies; and cutting the laminate to separate the individual condenser microphone constituting bodies.

2. The condenser microphone manufacturing method according to claim 1, wherein the spacer forming member has a plurality of through holes for defining the spacers so that the laminate is cut at the portions of the individual through holes.

3. The condenser microphone manufacturing method according to claim 2, wherein the case forming member has a plurality of through holes around the holes so that the laminate is cut at the portions of the individual through holes.

4. The condenser microphone manufacturing method according to claim 3, wherein the through holes of the spacer forming member and the through holes of the case forming member are formed in the laminate at mutually corresponding positions.

5. The condenser microphone manufacturing method according to claim 1, wherein the diaphragm plate forming member, the diaphragm sheet and the spacer forming member are individually provided with mutually communicating through holes, through which the diaphragm plate forming member and the impedance conversion circuit are made conductive.

6. The condenser microphone manufacturing method according to claim 2, wherein the diaphragm plate forming member, the diaphragm sheet and the spacer forming member are individually provided with mutually communicating through holes, through which the diaphragm plate forming member and the impedance conversion circuit are made conductive.

7. The condenser microphone manufacturing method according to claim 3, wherein the diaphragm plate forming member, the diaphragm sheet and the spacer forming member are individually provided with mutually communicating through holes, through which the diaphragm plate forming member and the impedance conversion circuit are made conductive.

8. The condenser microphone manufacturing method according to claim 4, wherein the diaphragm plate forming member, the diaphragm sheet and the spacer forming member are individually provided with mutually communicating through holes, through which the diaphragm plate forming member and the impedance conversion circuit are made conductive.

9. The condenser microphone manufacturing method according to claim 1, wherein the spacer forming member, the diaphragm sheet and the diaphragm plate forming member are integrally laminated into a diaphragm assembly, which is then integrated with the case forming member.

10. The condenser microphone manufacturing method according to claim 2, wherein the spacer forming member, the diaphragm sheet and the diaphragm plate forming member are integrally laminated into a diaphragm assembly, which is then integrated with the case forming member.

11. The condenser microphone manufacturing method according to claim 3, wherein the spacer forming member, the diaphragm sheet and the diaphragm plate forming member are integrally laminated into a diaphragm assembly, which is then integrated with the case forming member.

12. The condenser microphone manufacturing method according to claim 1, wherein a cover forming member for forming a cover to cover the diaphragm is further integrally laminated at the laminate on the side of the diaphragm plate forming member and is then cut.

13. The condenser microphone manufacturing method according to claim 2, wherein a cover forming member for forming a cover to cover the diaphragm is further integrally laminated at the laminate on the side of the diaphragm plate forming member and is then cut.

14. The condenser microphone manufacturing method according to claim 3, wherein a cover forming member for forming a cover to cover the diaphragm is further integrally laminated at the laminate on the side of the diaphragm plate forming member and is then cut.

15. The condenser microphone manufacturing method according to claim 1, further using a cover member, in which a tensing portion for tensing a diaphragm on the opposite side of the casing across the diaphragm and a protecting portion arranged to cover and protect the diaphragm are integrally formed.

16. The condenser microphone manufacturing method according to claim 15, wherein the cover member is made of a metal sheet.

17. The condenser microphone manufacturing method according to claim 16, wherein the cover member has a recess formed in the face of the protecting portion on the side of the diaphragm so that the portion, as corresponding to the recess, of the diaphragm can vibrate.

18. The condenser microphone manufacturing method according to claim 15, wherein the cover member is formed of a circuit board.

19. The condenser microphone manufacturing method according to claim 18, wherein the recess is formed by forming the tensing portion of the circuit board into an area having an electrode pattern layer on its surface and by forming the protecting portion into an area having no electrode pattern layer on its surface, so that the portion, as corresponding to the recess, of the diaphragm can vibrate.

* * * * *